US010334999B1

(12) United States Patent
Brunelle

(10) Patent No.: US 10,334,999 B1
(45) Date of Patent: Jul. 2, 2019

(54) TISSUE DISPENSING ASSEMBLY

(71) Applicant: Cindy Brunelle, Burlington, MA (US)

(72) Inventor: Cindy Brunelle, Burlington, MA (US)

( * ) Notice: Subject to any disclaimer, the term of this patent is extended or adjusted under 35 U.S.C. 154(b) by 0 days.

(21) Appl. No.: 15/855,219

(22) Filed: Dec. 27, 2017

(51) Int. Cl.
*A47K 10/42* (2006.01)
*A63H 3/00* (2006.01)
*B65D 83/08* (2006.01)

(52) U.S. Cl.
CPC ..... *A47K 10/421* (2013.01); *A63H 3/005* (2013.01); *B65D 83/0894* (2013.01)

(58) Field of Classification Search
CPC ... A47K 10/421; A63H 3/005; B65D 83/0894
USPC ..... 221/199, 282, 24, 45, 63, 33, 312 C; 119/174; 383/24, 41, 67
See application file for complete search history.

(56) References Cited

U.S. PATENT DOCUMENTS 2,484,776 A * 10/1949 Zent ..... B65D 85/00 206/446
3,648,910 A * 3/1972 Benson ..... A47K 10/40 225/44
4,816,000 A * 3/1989 Hsu ..... A63H 3/005 206/457
4,978,030 A * 12/1990 Morris ..... B65D 81/365 221/24
4,979,923 A * 12/1990 Tanaka ..... A61F 7/007 219/201
5,007,558 A 4/1991 Allen et al.
5,375,928 A * 12/1994 Yarng ..... B65D 83/08 150/154
D353,996 S 1/1995 Boysen
D392,825 S 3/1998 Markelonis
5,947,277 A * 9/1999 Sherman ..... A47F 13/085 206/216
D437,155 S 2/2001 Steele et al.
6,189,730 B1 * 2/2001 McClymonds .... A47K 10/3818 221/197
6,237,787 B1 5/2001 Gallo et al.
6,510,963 B1 1/2003 Walker et al.
6,824,112 B2 * 11/2004 Lange ..... A61J 9/0607 248/102
7,066,422 B1 * 6/2006 Slocum ..... B65H 18/28 242/160.4
7,380,687 B2 * 6/2008 FitzSimons ..... A47K 10/38 221/199
7,922,029 B1 * 4/2011 Aretz ..... B65F 1/068 220/254.2
D654,739 S * 2/2012 Chin ..... D3/215
(Continued)

*Primary Examiner* — Rakesh Kumar

(57) ABSTRACT

A tissue dispensing assembly for discrete tissue access includes a first shell that defines an interior space and a second shell that defines an internal space. The second shell has an upper end that is open. A plurality of tissues, which is rolled, is configured to position in the internal space. A first hole and a second hole are positioned in a top and a bottom of the first shell, respectively. A panel is coupled to and extends between a perimeter of the first hole and a circumference of the second hole to defines a chamber in the interior space. The second hole is positioned to insert the second shell into the chamber so that a terminal sheet of the plurality of tissues is positioned through the first hole. The terminal sheet is extracted by pulling concurrent with positioning of an adjacent sheet through the first hole.

1 Claim, 5 Drawing Sheets

(56) References Cited

U.S. PATENT DOCUMENTS

| | | | | |
|---|---|---|---|---|
| 8,505,770 | B2 * | 8/2013 | Askinasi | A01K 23/00 119/174 |
| 2002/0084279 | A1 * | 7/2002 | Lickstein | A47K 10/42 221/24 |
| 2005/0211719 | A1 * | 9/2005 | Vani | A47K 10/426 221/63 |
| 2006/0118569 | A1 * | 6/2006 | Edwards | B65H 35/10 221/63 |
| 2006/0118588 | A1 * | 6/2006 | Edwards | B65H 35/10 225/6 |
| 2007/0138196 | A1 * | 6/2007 | Nguyen | A47K 10/42 221/33 |
| 2008/0110918 | A1 * | 5/2008 | Lee | A47K 10/3818 221/45 |
| 2009/0066201 | A1 * | 3/2009 | Colon | A47K 10/38 312/35 |
| 2011/0089188 | A1 * | 4/2011 | Askinasi | A01K 23/00 221/199 |

* cited by examiner

TISSUE DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing assemblies and more particularly pertains to a new dispensing assembly for discrete tissue access.

BRIEF SUMMARY OF THE INVENTION

An embodiment of the disclosure meets the needs presented above by generally comprising a first shell that defines an interior space and a second shell that defines an internal space. The second shell has an upper end that is open. A plurality of tissues, which is rolled, is configured to position in the internal space. A first hole and a second hole are positioned in a top and a bottom of the first shell, respectively. A panel is coupled to and extends between a perimeter of the first hole and a circumference of the second hole to defines a chamber in the interior space. The second hole is positioned to insert the second shell into the chamber so that a terminal sheet of the plurality of tissues is positioned through the first hole. The terminal sheet is extracted by pulling concurrent with positioning of an adjacent sheet through the first hole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
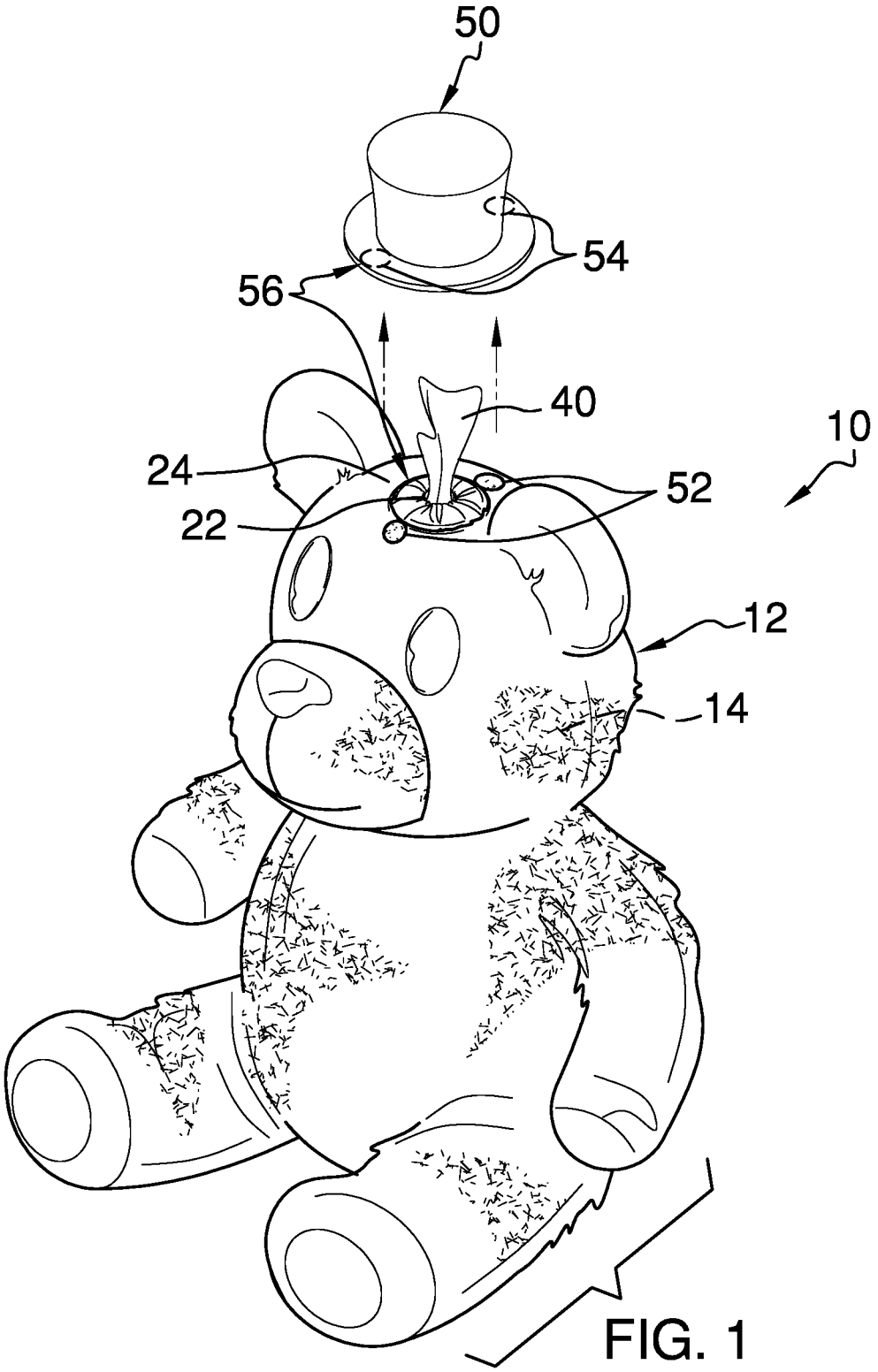
FIG. 1 is an isometric perspective view of a tissue dispensing assembly according to an embodiment of the disclosure.
Figure 2:
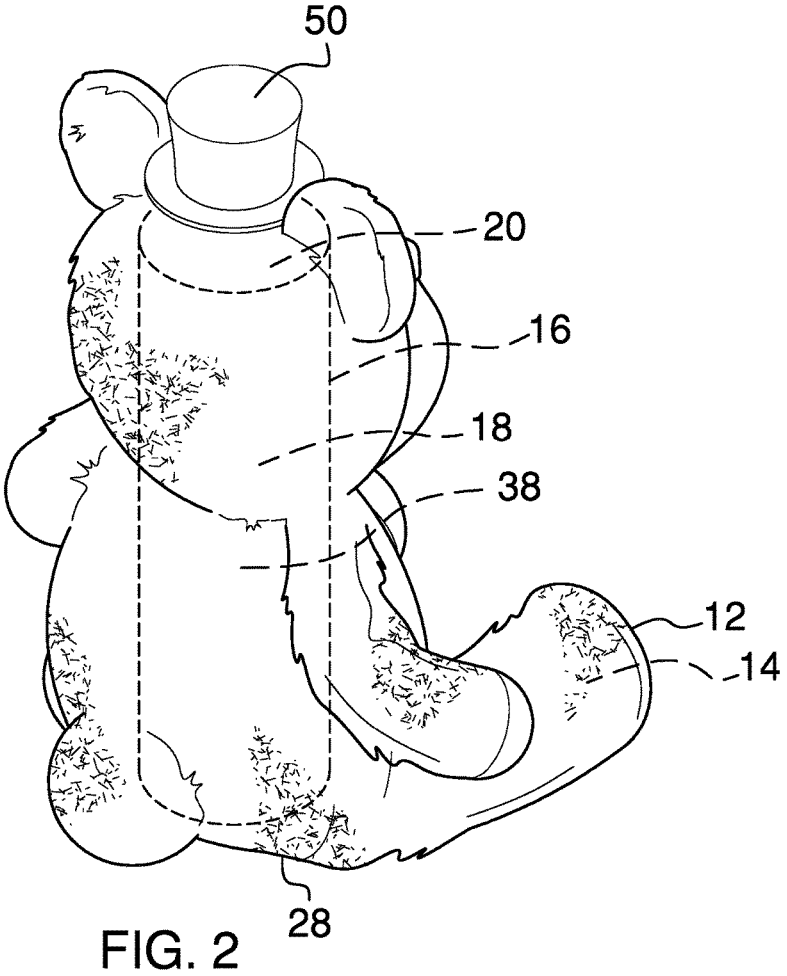
FIG. 2 is an isometric perspective view of an embodiment of the disclosure.
Figure 3:
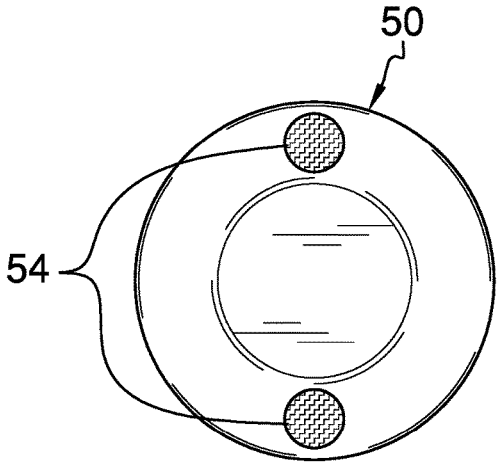
FIG. 3 is a bottom view of an embodiment of the disclosure.
Figure 4:
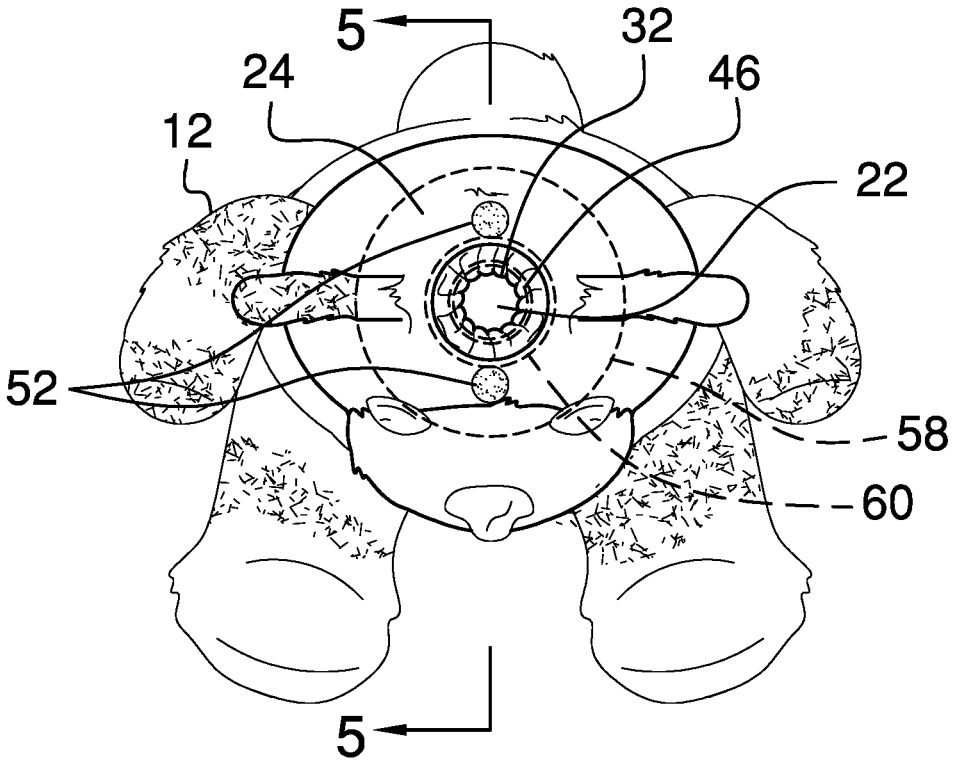
FIG. 4 is a top view of an embodiment of the disclosure.
Figure 5:
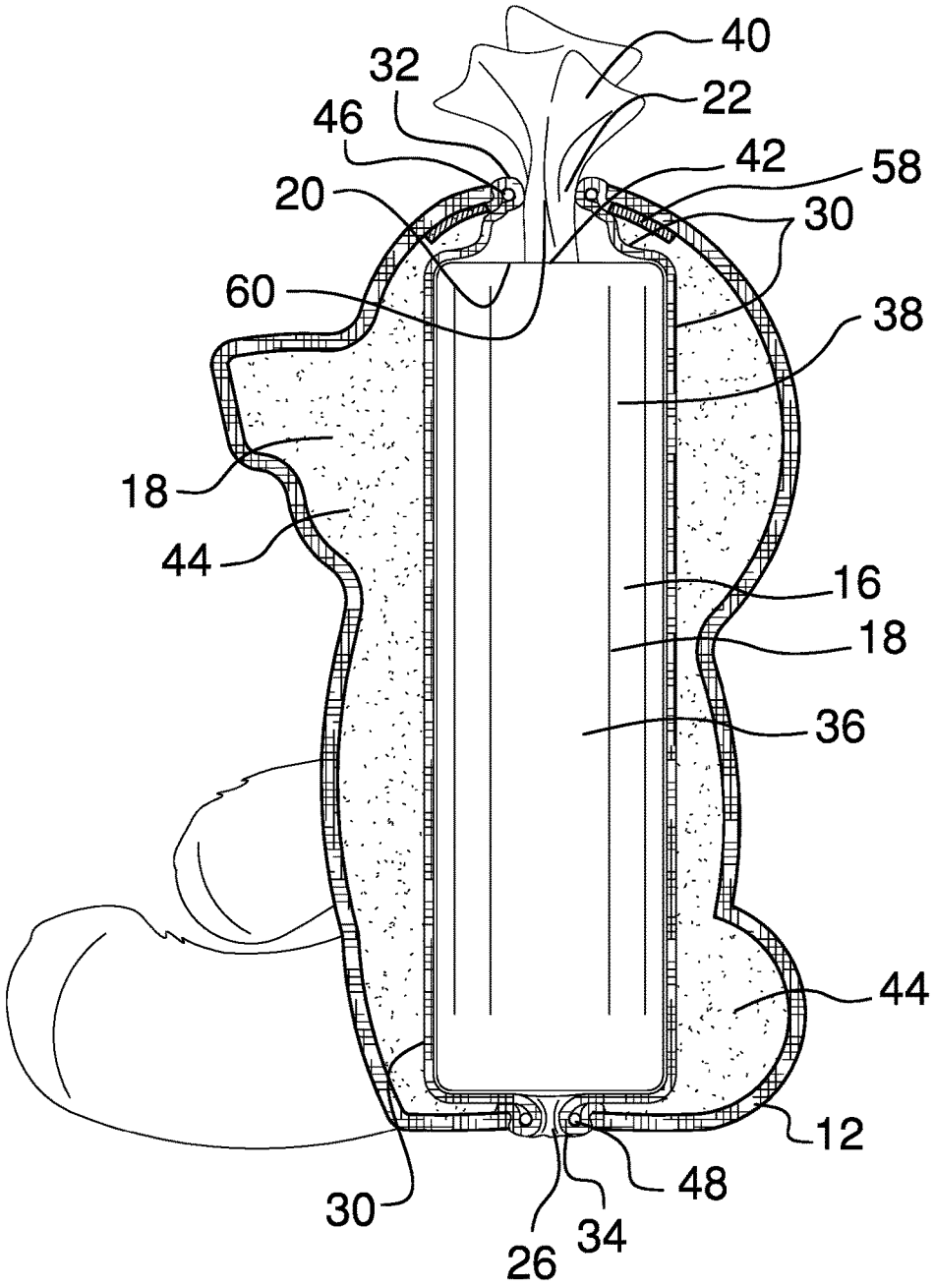
FIG. 5 is a cross-sectional view of an embodiment of the disclosure.
Figure 6:
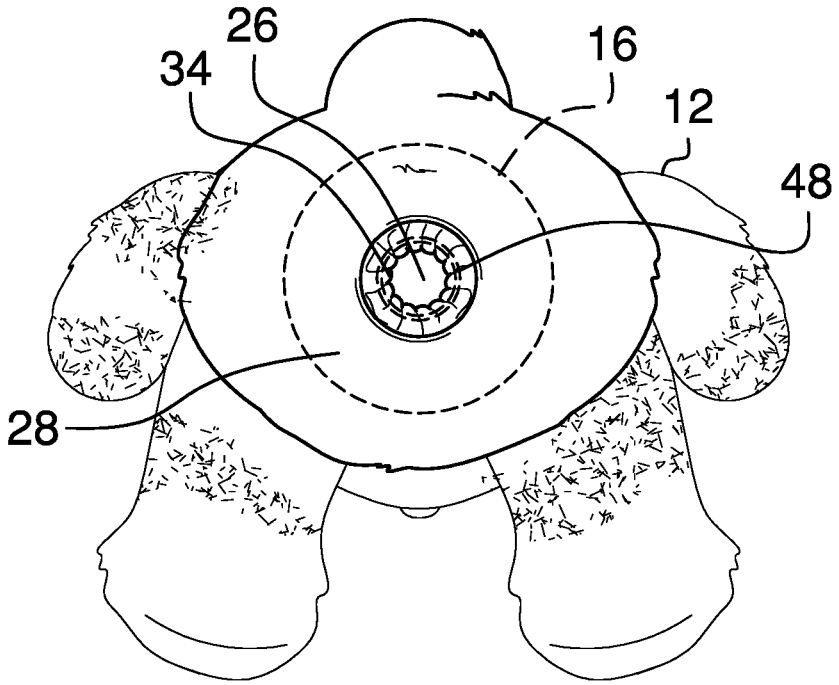
FIG. 6 is a bottom view of an embodiment of the disclosure.

With reference now to the drawings, and in particular to FIGS. 1 through 6 thereof, a new dispensing assembly embodying the principles and concepts of an embodiment of the disclosure and generally designated by the reference numeral 10 will be described.

As best illustrated in FIGS. 1 through 6, the tissue dispensing assembly 10 generally comprises a first shell 12 that defines an interior space 14 and second shell 16 that defines an internal space 18. The first shell 12 comprises fabric or the like. The first shell 12 is configured to resemble an animal, such as a bear or the like. The second shell 16 has an upper end 20 that is open. The second shell 16 is cylindrically shaped.

A first hole 22 is positioned in a top 24 of the first shell 12. A second hole 26 is positioned in a bottom 28 of the first shell 12. A panel 30 is coupled to and extends between a perimeter 32 of the first hole 22 and a circumference 34 of the second hole 26 to define a chamber 36 in the interior space 14. The panel 30 is resilient. The chamber 36 is positioned to expand to insert the second shell 16 through the second hole 26 into the chamber 36. The upper end 20 of the second shell 16 is positioned adjacent to the first hole 22. The panel 30 comprises fabric, plastic, or the like.

A plurality of tissues 38, which is rolled, is configured to position in the internal space 18. A terminal sheet 40 of the plurality of tissues 38 is configured to position through the first hole 22. The terminal sheet 40 is configured to be grasped in a hand of a user to extract the terminal sheet 40 from the internal space 18 concurrent with positioning of an adjacent sheet 42 through the first hole 22.

Stuffing 44 is positioned in and substantially occupies the interior space 14 between the panel 30 and the first shell 12. The stuffing 44 is resilient. The stuffing 44 comprises polyester fill or the like.

A first retainer 46 is coupled to the perimeter 32 of the first hole 22. The first retainer 46 is resilient. The first retainer 46 is positioned to substantially close the first hole 22. The first shell 12 is in frictional contact with the adjacent sheet 42 to promote separation of the terminal sheet 40 from the plurality of tissues 38. The first retainer 46 comprises elastic or the like.

A second retainer 48 is coupled to the circumference 34 of the second hole 26. The second retainer 48 is resilient. The second retainer 48 is positioned to expand to insert the second shell 16 into, and withdraw the second shell 16 from, the chamber 36. The second retainer 48 also is positioned to contract to substantially close the second hole 26. The panel 30 is coupled to and extends between the first retainer 46 and the second retainer 48. The second retainer 48 comprises elastic or the like.

A lid 50 is configured to selectively couple to the top 24 of the first shell 12 to cover the first hole 22 and the terminal sheet 40. The lid 50 is top hat shaped.

A plurality of first couplers 52 is coupled to the top 24 of the first shell 12 proximate to the first hole 22. A plurality of second couplers 54 is coupled to the lid 50. The second couplers 54 are complementary to the first couplers 52. Each second coupler 54 is positioned to selectively couple to a respective first coupler 52 to couple the lid 50 to the first shell 12 to cover the first hole 22 and the terminal sheet 40. Each second coupler 54 and the respective first coupler 52 comprise a hook and loop fastener 56. The plurality of first couplers 52 comprises two first couplers 52 that are opposingly positioned and proximate to the perimeter 32 of the first hole 22.

A disk 58 is positioned in the interior space 14 and is coupled to the top 24 of the first shell 12. An orifice 60 centrally positioned through the disk 58 is complementary to and aligned with the first hole 22. The disk 58 comprises stiffened fabric, stiffened felt, or the like, so that the disk 58 is semi-rigid. The disk 58 is positioned to prevent the first shell 12 from being depressed proximate to the first hole 22.

In use, the second retainer 48 is positioned to expand to insert the second shell 16 through the second hole 26 into the chamber 36 and to contract to substantially close the second hole 26. The terminal sheet 40 of the plurality of tissues 38 is configured to position through the first hole 22. The terminal sheet 40 is configured to be grasped in the hand of the user to extract the terminal sheet 40 from the internal space 18 concurrent with positioning of the adjacent sheet 42 through the first hole 22. The first retainer 46 is positioned to substantially close the first hole 22 so that the first shell 12 is in frictional contact with the adjacent sheet 42 to promote separation of the terminal sheet 40 from the plurality of tissues 38. Each second coupler 54 is positioned to selectively couple to the respective first coupler 52 to couple the lid 50 to the first shell 12 to cover the first hole 22 and the terminal sheet 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tissue dispensing assembly comprising:

a first shell defining an interior space, said first shell comprising fabric, said first shell being configured for resembling an animal, said first shell being configured for resembling a bear;

a second shell defining an internal space, said second shell having an upper end, said upper end being open, said second shell being cylindrically shaped;

a first hole positioned in a top of said first shell;

a second hole positioned in a bottom of said first shell;

a panel coupled to and extending between a perimeter of said first hole and a circumference of said second hole defining a chamber in said interior space, said panel being resilient such that said chamber is positioned for expanding for inserting said second shell through said second hole into said chamber, wherein said second hole is positioned in said first shell such that said second hole is positioned for inserting said second shell into said chamber positioning said upper end of said second shell adjacent to said first hole, said panel comprising fabric, said panel comprising plastic;

a plurality of tissues, said plurality of tissues being rolled such that said plurality of tissues is configured for positioning in said internal space, wherein said plurality of tissues is positioned in said second shell such that a terminal sheet of said plurality of tissues is configured for positioning through said first hole such that said terminal sheet is configured for grasping in a hand of a user for extracting said terminal sheet from said internal space concurrent with positioning of an adjacent sheet through said first hole;

stuffing positioned in and substantially occupying said interior space between said panel and said first shell, said stuffing being resilient, said stuffing comprising polyester fill;

a first retainer coupled to said perimeter of said first hole, said first retainer being resilient, wherein said first retainer is positioned on said first shell such that said first retainer is positioned for substantially closing said first hole such that said first shell is in frictional contact with said adjacent sheet for promoting separation of said terminal sheet from said plurality of tissues, said first retainer comprising elastic;

a second retainer coupled to said circumference of said second hole, said second retainer being resilient, wherein said second retainer is positioned on said first shell such that said second retainer is positioned for expanding for inserting said second shell into and withdrawing said second shell from said chamber and for contracting for substantially closing said second hole, said panel being coupled to and extending between said first retainer and said second retainer, said second retainer comprising elastic;

a lid configured for selectively coupling to said top of said first shell for covering said first hole and said terminal sheet, said lid being top hat shaped;

a plurality of first couplers coupled to said top of said first shell proximate to said first hole;

a plurality of second couplers coupled to said lid, said second couplers being complementary to said first couplers, wherein said second couplers are positioned on said lid such that each said second coupler is positioned for selectively coupling to a respective said first coupler for coupling said lid to said first shell for covering said first hole and said terminal sheet, each said second coupler and said respective said first coupler comprising a hook and loop fastener, said plurality of first couplers comprising two said first couplers opposingly positioned and proximate to said perimeter of said first hole;

a disk positioned in said interior space and coupled to said top of said first shell, said disk comprising stiffened fabric such that said disk is semi-rigid, said disk comprising stiffened felt;

an orifice centrally positioned through said disk, said orifice being complementary to and aligned with said first hole, wherein said disk is positioned on said first shell such that said disk is positioned for preventing said first shell from being depressed proximate to said first hole; and wherein said second retainer is positioned on said first shell such that said second retainer is positioned for expanding for inserting said second shell through said second hole into said chamber and for contracting for substantially closing said second hole, wherein said plurality of tissues is positioned in said second shell such that said terminal sheet of said plurality of tissues is configured for positioning through said first hole such that said terminal sheet is configured for grasping in the hand of the user for extracting said terminal sheet from said internal space concurrent with positioning of said adjacent sheet through said first hole, wherein said first retainer is positioned on said first shell such that said first retainer is positioned for substantially closing said first hole such that said first shell is in frictional contact with said adjacent sheet for promoting separation of said terminal sheet from said plurality of tissues, wherein said second couplers are positioned on said lid such that each said second coupler is positioned for selectively coupling to said respective said first coupler for coupling said lid to said first shell for covering said first hole and said terminal sheet.

* * * * *